US012612567B2

(12) United States Patent
Jiang et al.

(10) Patent No.: US 12,612,567 B2
(45) Date of Patent: Apr. 28, 2026

(54) COUPLING PROCESS FOR PRODUCING BIODIESEL FROM WASTE FOG

(71) Applicant: FUZHOU UNIVERSITY, Fuzhou (CN)

(72) Inventors: Lilong Jiang, Fuzhou (CN); Kuan Huang, Fuzhou (CN); Zhenping Cai, Fuzhou (CN); Yanning Cao, Fuzhou (CN); Yongde Ma, Fuzhou (CN)

(73) Assignee: FUZHOU UNIVERSITY, Fuzhou (CN)

( * ) Notice: Subject to any disclaimer, the term of this patent is extended or adjusted under 35 U.S.C. 154(b) by 215 days.

(21) Appl. No.: 18/518,830

(22) Filed: Nov. 24, 2023

(65) Prior Publication Data

US 2024/0174931 A1 May 30, 2024

(30) Foreign Application Priority Data

Nov. 25, 2022 (CN) ..... 202211488975.4

(51) Int. Cl.
*C10G 67/14* (2006.01)

(52) U.S. Cl.
CPC ..... *C10G 67/14* (2013.01); *C10G 2300/1003* (2013.01); *C10G 2300/202* (2013.01); *C10G 2300/4006* (2013.01); *C10G 2300/4012* (2013.01); *C10G 2300/4018* (2013.01); *C10G 2400/04* (2013.01)

(58) Field of Classification Search
CPC .... C10G 2300/1003; C10G 2300/1007; C10G 2300/201; C10G 2300/202; C10G 2300/4006; C10G 2300/4012; C10G 2300/4018; C10G 2400/04; C10G 2400/06; C10G 2400/08; C10G 25/00; C10G 3/46; C10G 3/49; C10G 3/50; C10G 31/09; C10G 45/02; C10G 45/62; C10G 65/12; C10G 67/06; C10G 67/14; C10G 69/02; C11B 13/00; C11C 3/003; Y02E 50/10
See application file for complete search history.

(56) References Cited

FOREIGN PATENT DOCUMENTS

CN 114574234 B * 2/2024 ..... C10G 3/48

OTHER PUBLICATIONS

CN114574234 English Translation (Year: 2022).*

* cited by examiner

*Primary Examiner* — Ellen M Mcavoy
*Assistant Examiner* — Chantel Graham
(74) *Attorney, Agent, or Firm* — OLIFF PLC.

(57) ABSTRACT

A coupling process for producing biodiesel from a waste FOG including: among others, 1) removing solid impurities from a waste FOG, then mixing with an alcohol and liquid acid catalyst to generate a pre-esterified mixture; 2) mixing the mixture with water, and charging the mixture to separate an aqueous phase to remove metal ions to obtain an esterification product II; 3) mixing the product II with a vulcanizator and $H_2$ to generate a product I; 4) and separating the product I to obtain an oil phase, mixing the oil phase with $H_2$ and passing the mixture into a fixed-bed reactor, and using a gas-liquid separator for separation to obtain an oil phase product II.

11 Claims, 1 Drawing Sheet

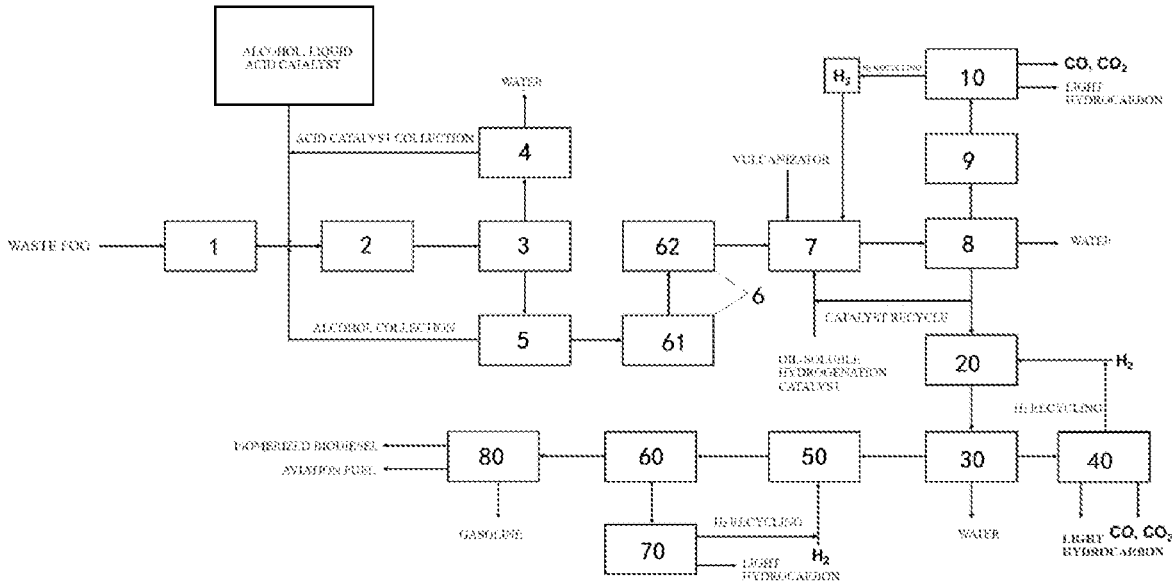
ALCOHOL, LIQUID ACID CATALYST
WATER
ACID CATALYST COLLECTION
4
VULCANIZATION
$H_2$
10
$CO, CO_2$
LIGHT HYDROCARBON
9
WASTE FOG
1
2
3
62
7
8
WATER
6
CATALYST RECYCLE
ALCOHOL COLLECTION
5
61
OIL-SOLUBLE HYDROGENATION CATALYST
20
$H_2$
$H_2$ RECYCLING
DOMESTIC BIODIESEL
AVIATION FUEL
80
60
50
30
40
GASOLINE
70
$H_2$ RECYCLING
$H_2$
LIGHT HYDROCARBON
WATER
LIGHT HYDROCARBON
$CO, CO_2$

COUPLING PROCESS FOR PRODUCING BIODIESEL FROM WASTE FOG

TECHNICAL FIELD

The present invention relates to the technical field of catalytic conversion of bio-FOG particularly to a coupling process for producing biodiesel from a waste FOG.

BACKGROUND ART

The development and utilization of fossil resources have greatly promoted the progress of human civilization and the development of modern industry, but causes a series of environmental problems such as warming, acid rain, and haze. In addition, the fossil resources are non-renewable resources, and reserves thereof are becoming increasingly depleted with the rapid growth in the global population. Therefore, it is urgent to develop new green renewable energy. A renewable liquid fuel, i.e., biodiesel which is obtained by subjecting FOG such as animal fats and vegetable oils, microbial oils, and waste cooking oils that are used as raw materials to transesterification or hydrodeoxygenation reactions has received widespread attention and is one of the important development directions to reduce carbon emissions and cope with climate changes. Bio-FOG is composed of long-chain fatty acid glycerides, free fatty acids, etc., and has a carbon chain structure similar to that of petrochemical diesel. According to the forecast of International Energy Agency, the global annual demand of biodiesel will exceed 50 million tons, and the annual demand of biodiesel in China will reach 7.5 million tons by 2030. As compared with the animal fats and vegetable oils, waste FOG in China has a wider range of sources. About 11 million tons of waste FOG such as illegally recycled waste cooking oils, acidified oils, and hogwash oils are produced every year. Therefore, the development of a biodiesel preparation technology using waste FOG as a raw material has important strategic significance and industrial application prospects.

Biodiesel is mainly the first-generation biodiesel, i.e., a fatty acid methyl ester produced through a transesterification reaction. However, this type of biodiesel has problems such as a high oxygen content, poor stability, and poor low-temperature fluidity, and cannot be directly used as a fuel. This type of biodiesel is only used as an additive for petrochemical diesel. The addition amount of the first-generation biodiesel generally does not exceed 5%, which greatly limits an application value thereof. Therefore, the current research focus in this field is to hydrodeoxygenate FOG to obtain a hydrocarbon mixture with a similar composition to traditional petrochemical diesel, that is, second-generation biodiesel. The second-generation biodiesel has the advantages of a high cetane number, a low oxygen content, and high stability, and can be mixed with petrochemical diesel in any proportion. In the actual production process, branched alkane products are generated through a hydroisomerization process during hydrodeoxygenation, and as a result, a low-temperature flow performance of biodiesel is further reduced.

At present, there are many commercial cases reported on the generation of the second-generation biodiesel. Examples of the commercial cases include NExBTL technology developed by Neste Corporation in Finland, Ecofining technology jointly developed by UOP Corporation in the United States and ENI Corporation in Italy, and RN-OIL technology of Sinopec in China. However, higher-priced refined vegetable oils are mainly used as raw materials in most of the existing technologies. For example, edible FOG such as rapeseed oil and soybean oil is used as raw materials in the RN-OIL process, which competes with people for food. At the same time, when the waste FOG is used as raw materials in the existing process, the system is less likely to operate stably for a long period of time because a high content of impurities such as free fatty acids, phospholipids, metal ions, and water are present in the waste FOG so that a catalyst is powdered and inactivated. Therefore, there is an urgent need to develop a second-generation biodiesel production process using the waste FOG as raw materials to improve the production efficiency and economic benefits of the second-generation biodiesel.

SUMMARY OF INVENTION

In view of the shortcomings of the existing technology, the present invention provides a coupling process for producing biodiesel from a waste FOG. The production process is stable and reliable and has strong adaptability to raw materials. Raw materials such as catalysts and excessive hydrogen gas can be recycled during a production process to ensure long-term operation of a system.

The present invention adopts the following technical solutions.

A coupling process for producing biodiesel from a waste FOG includes:

- a step S1 of preheating and dissolving a waste FOG, charging the dissolved waste FOG into a filter to remove solid impurities, and charging the filtrate and a certain amount of a short-chain alcohol and a liquid acid catalyst into a pre-esterification reactor for a pre-esterification reaction to generate a pre-esterified mixture;
- a step S2 of charging the pre-esterified mixture into a liquid-liquid separator for liquid-liquid separation to separate out an aqueous phase and an organic phase, separating the organic phase using a second flash separator to obtain a pre-esterification product I and an alcohol solvent, and charging the pre-esterification product I into a water scrubber to remove metal ions to obtain an esterification product II;
- a step S3 of pre-hydrogenating the esterification product II, an oil-soluble hydrogenation catalyst, a vulcanizator, and hydrogen gas in a suspended-bed reactor to generate a product I;
- a step S4 of charging the product I into a gas-liquid-solid separator, and passing the separated components through a desulfurization adsorption tower and a first pressure swing adsorption tower for recycling and collection of the hydrogen gas and the hydrogenation catalyst, to obtain an oil phase product I;
- a step S5 of mixing the oil phase product I and hydrogen gas, charging the mixture into a fixed-bed reactor for a deep deoxygenation reaction to obtain a mixed product I, and separating the mixed product I using a first gas-liquid separator to obtain an oil phase product II;
- a step S6 of mixing the oil phase product II and hydrogen gas, and charging the mixture into a hydroisomerization reactor for an isomerization reaction under an action of a catalyst, to generate a product II; and
- a step S7 of charging the product II into a second gas-liquid separator to separate out a gas phase and a liquid phase, and charging the liquid phase product into a fractionation tower to separate out isomerized biodiesel and an aviation fuel product.

The aqueous phase separated out in the step S2 is charged into a first flash separator to separate out a liquid acid catalyst and water, and the liquid acid catalyst is collected and returned to the pre-esterification reactor.

The alcohol solvent separated out by the second flash separator in the step S2 is collected and returned to the pre-esterification reactor.

In the step S2, the pre-esterification product I passes through a first water scrubber and a second water scrubber to remove the metal ions to obtain the esterification product II.

A gas phase product separated out in the step S5 is charged into a second pressure swing adsorption tower to separate out CO, $CO_2$, hydrogen gas, and light hydrocarbons, and the hydrogen gas is recycled back to the fixed-bed reactor.

The gas phase product separated out in the step S7 is charged into a third pressure swing adsorption tower to separate out hydrogen gas and light hydrocarbons, and the hydrogen gas is recycled back to the hydroisomerization reactor.

In the step S1, the added waste FOG includes but is not limited to one or more of an acidified oil, a hogwash oil, and an illegally recycled waste cooking oil, the added short-chain alcohol includes but is not limited to any one of methanol, ethanol, propanol, and butanol, and the added liquid acid catalyst includes but is not limited to one or more of sulfuric acid, hydrochloric acid, and an acidic ionic liquid.

In the step S1, a pre-esterification temperature is 50° C. to 85° C., and a mass ratio of the added waste FOG to the liquid acid catalyst to the short-chain alcohol is 1:(0.05 to 0.25):(0.80 to 1.50).

In the step S3, the added vulcanizator includes but is not limited to one of sulfur powder, carbon disulfide, dimethyl disulfide, and $H_2S$, and the added oil-soluble hydrogenation catalyst includes but is not limited to one or more of a molybdate imidazole ionic liquid, a molybdate pyridine ionic liquid, a molybdate quaternary ammonium ionic liquid, and a transition metal chloride ionic liquid, in which the transition metal chloride is one or more of $NiCl_2$, $CoCl_2$, $CuCl_2$, and $FeCl_3$.

In the step S3, a molar ratio of the esterification product II to the oil-soluble hydrogenation catalyst added is (1000 to 5000):1, and a molar ratio of the esterification product II to the vulcanizator added is (300 to 1000):1.

In the step S4, the product I passes through the gas-liquid-solid separator, and a gas phase product is charged into the desulfurization adsorption tower to remove residual $H_2S$ gas, followed by charging into the pressure swing adsorption tower to separate out CO, $CO_2$, and light hydrocarbons and collect $H_2$.

In the step S4, the hydrogenation catalyst separated out by the gas-liquid-solid separator is filtered and charged into the suspended-bed reactor for recycling, and the oil phase product I is charged into the fixed-bed reactor for the deep deoxygenation reaction.

The hydrogenation catalyst added in the step S3 is one of NiMOS and CoMoS supported on graphitized mesoporous carbon, and regarding the prehydrogenation reaction, an operating pressure is 2 MPa to 10 MPa, a reaction temperature is 280° C. to 400° C., a liquid hourly space velocity is 0.2 $h^{-1}$ to 8 $h^{-1}$, and a hydrogen-oil ratio is 500 to 1500.

In the step S6, the catalyst used in the hydroisomerization reactor includes but is not limited to one of $Pt/ZrO_2$, $Pt/Al_2O_3$, and $Pt/ZrPO_x$.

In the step S6, regarding the hydroisomerization reaction, an operating pressure is 2 MPa to 10 MPa, a reaction temperature is 280° C. to 400° C., a liquid hourly space velocity is 0.2 $h^{-1}$ to 8 $h^{-1}$, and a hydrogen-oil ratio is 500 to 1500.

In the step S7, an operating temperature in the second gas-liquid separator is 25° C. to 45° C., the fractionation tower is of a sieve plate type or a packed type, a temperature at a bottom of the tower is 200° C. to 360° C., and an operating pressure is 0.1 MPa to 0.4 MPa.

The technical solution of the present invention has the following advantages.

A. The coupling process for producing biodiesel from a waste FOG provided by the present invention has a stable and reliable process flow and strong adaptability to raw materials. The added pre-esterification process can effectively reduce contents of a fatty acid and a metal in the waste FOG and solve the problem of powdering and inactivation of a catalyst due to a too high acid value and metal deposition. At the same time, a suspended bed pre-hydrogenation reactor is disposed in front of the fixed-bed reactor to remove impurities such as residual metals, phospholipids, and unsaponifiable matters in the waste FOG so that the fixed-bed deep deoxidation reactor is further effectively protected and a long-term stable operation of the overall system is implemented.

B. In the present invention, a good catalytic conversion efficiency for FOG is obtained, and an alkane yield can reach more than 90%, particularly an isoparaffin yield reaches 40% or more.

BRIEF DESCRIPTION OF DRAWINGS

In order to illustrate the specific embodiments in the present invention more clearly, the drawings needed to be used in the specific embodiments will be briefly introduced below.

Obviously, the drawings in the following description are some embodiments in the present invention. Those having ordinary skills in the art can obtain other drawings based on these drawings without exerting creative work.

FIG. 1 is a schematic flow diagram of a coupling process for producing biodiesel from a waste FOG according to the present invention.

The reference signs in the drawing are as follows:

1: filter; 2: pre-esterification reactor; 3: liquid-liquid separator; 4: flash separator; 5: second flash separator; 6: water scrubber, 61: first water scrubber, 62: second water scrubber; 7: suspended-bed reactor; 8: gas-liquid-solid separator; 9: desulfurization adsorption tower; 10: first pressure swing adsorption tower; 20: fixed-bed reactor; 30: first gas-liquid separator; 40: second pressure swing adsorption tower; 50: hydroisomerization reactor; 60: second gas-liquid separator; 70: third pressure swing adsorption tower; 80: fractionation tower.

DESCRIPTION OF EMBODIMENTS

The technical solution of the present invention will be clearly and completely described below with reference to the accompanying drawings. Obviously, the described embodiments are some, not all, of the embodiments in the present invention. Based on the embodiments in the present invention, all other embodiments obtained by those having ordinary skills in the art without creative work fall within the protection scope of the present invention.

Example 1

As shown in FIG. 1, the present embodiment provides a coupling process for producing biodiesel from a waste FOG The coupling process includes the following steps.

S1. The waste FOG was heated and dissolved at 100° C., then the dissolved waste FOG was charged into a filter 1 to filter out a solid residue at a temperature of 100° C. and a normal pressure, and then the filtrate was mixed with methanol and concentrated sulfuric acid, followed by charging into a pre-esterification reactor 2 for a pre-esterification reaction at 80° C. to obtain a pre-esterified mixture. A mass ratio of methanol to FOG was 1.2:1, and a mass ratio of concentrated sulfuric acid to FOG was 0.1:1.

S2. The pre-esterified mixture and deionized water were mixed with each other at a ratio of 1:2, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 320° C. to obtain a product I. A ratio of the esterification product II to 1-octyl-3-methylimidazole molybdate was 1000:1, a ratio of the esterification product II to the sulfur powder was 500:1, a hydrogen-oil ratio was 1000, and an operating pressure was 5 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 320° C. to obtain a mixed product I. Regarding the catalyst, graphitized mesoporous carbon (MC) was used as a carrier, CoMoS was used as a dispersed phase, and a loading capacity was 10%. An operating pressure is 5 MPa, a liquid hourly space velocity is 4 $h^{-1}$, and a hydrogen-oil ratio is 1000. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 3%. A reaction temperature was 360° C., an operating pressure was 3 MPa, a liquid hourly space velocity was 4 $h^{-1}$, and a hydrogen-oil ratio was 1000.

The isomerized biodiesel was qualitatively and quantitatively analyzed using a gas chromatography-mass spectrometer and a gas chromatography-hydrogen flame ion detector. A yield of the obtained alkanes was 94.6%, and a proportion of isoparaffins was 42.1%.

Example 2

The present embodiment provides a coupling process for producing biodiesel from a waste FOG The coupling process includes the following steps.

S1. The waste FOG was heated and dissolved at 100° C., then the dissolved waste FOG was charged into a filter 1 to filter out a solid residue at a temperature of 100° C. and a normal pressure, and then the filtrate was mixed with methanol and concentrated sulfuric acid, followed by charging into a pre-esterification reactor 2 for a pre-esterification reaction at 85° C. to obtain a pre-esterified mixture. A mass ratio of methanol to FOG was 1.3:1, and a mass ratio of concentrated sulfuric acid to FOG was 0.15:1.

S2. The pre-esterified mixture and deionized water were mixed with each other at a ratio of 1:2.5, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 330° C. to obtain a product I. A ratio of the esterification product II to 1-octyl-3-methylimidazole molybdate was 2000:1, a ratio of the esterification product II to the sulfur powder was 500:1, a hydrogen-oil ratio was 1000, and an operating pressure was 6 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 320° C. to obtain a mixed product I. Regarding the catalyst, graphitized mesoporous carbon (MC) was used as a carrier, CoMoS was used as a dispersed phase, and a loading capacity was 15%. An operating pressure is 5 MPa, a liquid hourly space velocity is 3 $h^{-1}$, and a hydrogen-oil ratio is 1500. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 2%. A reaction temperature was 360° C., an operating pressure was 3 MPa, a liquid hourly space velocity was 3 $h^{-1}$, and a hydrogen-oil ratio was 1000.

The isomerized biodiesel was qualitatively and quantitatively analyzed using a gas chromatography-mass spectrometer and a gas chromatography-hydrogen flame ion detector. A yield of the obtained alkanes was 91.9%, and a proportion of isoparaffins was 46.3%.

Example 3

The present embodiment provides a coupling process for producing biodiesel from a waste FOG The coupling process includes the following steps.

S1. The waste FOG was heated and dissolved at 90° C., then the dissolved waste FOG was charged into a filter 1 to filter out a solid residue at a temperature of 90° C. and a normal pressure, and then the filtrate was mixed with methanol and concentrated sulfuric acid, followed by charging into a pre-esterification reactor 2 for a pre-esterification reaction at 70° C. to obtain a pre-esterified mixture. A mass ratio of methanol to FOG was 1.5:1, and a mass ratio of concentrated sulfuric acid to FOG was 0.2:1.

S2. The pre-esterified mixture and deionized water were mixed with each other at a ratio of 1:2, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 380° C. to obtain a product I. A ratio of the esterification product II to 1-octyl-3-methylimidazole molybdate was 3000:1, a ratio of the esterification product II to the sulfur powder was 500:1, a hydrogen-oil ratio was 1500, and an operating pressure was 6 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 320° C. to obtain a mixed product I. Regarding the catalyst, graphitized mesoporous carbon (MC) was used as a carrier, CoMoS was used as a dispersed phase, and a loading capacity was 5%. An operating pressure is 5 MPa, a liquid hourly space velocity is 5 $h^{-1}$, and a hydrogen-oil ratio is 1000. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 4%. A reaction temperature was 380° C., an operating pressure was 2 MPa, a liquid hourly space velocity was 8 $h^{-1}$, and a hydrogen-oil ratio was 1500.

The isomerized biodiesel was qualitatively and quantitatively analyzed using a gas chromatography-mass spectrometer and a gas chromatography-hydrogen flame ion detector. A yield of the obtained alkanes was 92.5%, and a proportion of isoparaffins was 48.4%.

Example 4

The present embodiment provides a coupling process for producing biodiesel from a waste FOG The coupling process includes the following steps.

S1. The waste FOG was heated and dissolved at 90° C., then the dissolved waste FOG was charged into a filter 1 to filter out a solid residue at a temperature of 90° C. and a normal pressure, and then the filtrate was mixed with methanol and concentrated sulfuric acid, followed by charging into a pre-esterification reactor 2 for a pre-esterification reaction at 50° C. to obtain a pre-esterified mixture. A mass ratio of methanol to FOG was 1.5:1, and a mass ratio of concentrated sulfuric acid to FOG was 0.25:1.

S2. The pre-esterified mixture and deionized water were mixed with each other at a ratio of 1:2.5, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 280° C. to obtain a product I. A ratio of the esterification product II to 1-octyl-3-methylimidazole molybdate was 1000:1, a ratio of the esterification product II to the sulfur powder was 300:1, a hydrogen-oil ratio was 1000, and an operating pressure was 10 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 340° C. to obtain a mixed product I. Regarding the catalyst, graphitized mesoporous carbon (MC) was used as a carrier, CoMoS was used as a dispersed phase, and a loading capacity was 12%. An operating pressure is 5 MPa, a liquid hourly space velocity is 4 $h^{-1}$, and a hydrogen-oil ratio is 500. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 3%. A reaction temperature was 400° C., an operating pressure was 10 MPa, a liquid hourly space velocity was 3 $h^{-1}$, and a hydrogen-oil ratio was 500.

The isomerized biodiesel was qualitatively and quantitatively analyzed using a gas chromatography-mass spectrometer and a gas chromatography-hydrogen flame ion detector. A yield of the obtained alkanes was 93.3%, and a proportion of isoparaffins was 47.1%.

Example 5

The present embodiment provides a coupling process for producing biodiesel from a waste FOG The coupling process includes the following steps.

S1. The waste FOG was heated and dissolved at 100° C., then the dissolved waste FOG was charged into a filter 1 to filter out a solid residue at a temperature of 100° C. and a normal pressure, and then the filtrate was mixed with methanol and concentrated sulfuric acid, followed by charging into a pre-esterification reactor 2 for a pre-esterification reaction at 60° C. to obtain a pre-esterified mixture. A mass ratio of methanol to FOG was 0.8:1, and a mass ratio of concentrated sulfuric acid to FOG was 0.2:1.

S2. The pre-esterified mixture and deionized water were mixed with each other at a ratio of 1:2, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 400° C. to obtain a product I. A ratio of the esterification product II to 1-octyl-3-methylimidazole molybdate was 3000:1, a ratio of the esterification product II to the sulfur powder was 500:1, a hydrogen-oil ratio was 500, and an operating pressure was 2 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 300° C. to obtain a mixed product I. Regarding the catalyst, graphitized mesoporous carbon (MC) was used as a carrier, CoMoS was used as a dispersed phase, and a loading capacity was 8%. An operating pressure is 2 MPa, a liquid hourly space velocity is 6 $h^{-1}$, and a hydrogen-oil ratio is 1000. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 3%. A reaction temperature was 280° C., an operating pressure was 3 MPa, a liquid hourly space velocity was 0.2 $h^{-1}$, and a hydrogen-oil ratio was 1000.

The isomerized biodiesel was qualitatively and quantitatively analyzed using a gas chromatography-mass spectrometer and a gas chromatography-hydrogen flame ion detector. A yield of the obtained alkanes was 93.7%, and a proportion of isoparaffins was 45.9%.

Example 6

S1. The waste FOG was heated and dissolved at 100° C., then the dissolved waste FOG was charged into a filter 1 to filter out a solid residue at a temperature of 100°

C. and a normal pressure, and then the filtrate was mixed with methanol and concentrated sulfuric acid, followed by charging into a pre-esterification reactor 2 for a pre-esterification reaction at 50° C. to obtain a pre-esterified mixture. A mass ratio of methanol to FOG was 1.1:1, and a mass ratio of concentrated sulfuric acid to FOG was 0.05:1.

S2. The pre-esterified mixture and deionized water were mixed with each other at a ratio of 1:2, and the mixture passed through a liquid-liquid separator 3 (operating temperature of 60° C.) to be separated into an aqueous phase and an organic phase. The aqueous phase was charged into a first flash separator 4 under a condition of 100° C. to collect the liquid acid catalyst, and the organic phase was separated using a second flash separator 5 under a condition of 80° C. to obtain a pre-esterification product I and an alcohol solvent. The pre-esterification product I passed through a first water scrubber 61 and a second water scrubber 62 to further remove impurities such as metal ions to obtain an esterification product II.

S3. The esterification product II, 1-octyl-3-methylimidazole molybdate, a sulfur powder, and hydrogen gas were pre-hydrogenated in a suspended-bed reactor 7 at 300° C. to obtain a product I. A ratio of the esterification product II to 1-octyl-3-methylimidazole molybdate was 5000:1, a ratio of the esterification product II to the sulfur powder was 1000:1, a hydrogen-oil ratio was 1500, and an operating pressure was 3 MPa.

S4. The product I was charged into a gas-liquid-solid separator 8, and the separated components passed through a desulfurization adsorption tower 9 and a first pressure swing adsorption tower 10 for recycling and collection of the hydrogen gas and a hydrogenation catalyst, to obtain an oil phase product I.

S5. The oil phase product I and hydrogen gas were mixed with each other, and then the mixture was charged into a fixed-bed reactor 20 for a deep deoxygenation reaction at 300° C. to obtain a mixed product I. Regarding the catalyst, graphitized mesoporous carbon (MC) was used as a carrier, CoMoS was used as a dispersed phase, and a loading capacity was 5%. An operating pressure is 4 MPa, a liquid hourly space velocity is 8 $h^{-1}$, and a hydrogen-oil ratio is 1500. The obtained mixed product I was charged into the first gas-liquid separator 30 to obtain an oil phase product II, and a gas phase product passed the first pressure swing adsorption tower 10 to collect the hydrogen gas.

S6. The oil phase product II and hydrogen gas were mixed with each other, and then the mixture was charged into a hydroisomerization reactor 50 for an isomerization reaction to generate a product II. The product II was charged into a second gas-liquid separator 60 to obtain a gas phase product and an oil phase product. The gas phase product was subjected to product separation using a third pressure swing adsorption tower 70, and the oil phase product was subjected to product separation using a fractionation tower 80 to obtain a final product, i.e., biodiesel, and other fractions, i.e., aviation fuels and gasoline products. Regarding an isomerization catalyst, $\gamma$-$Al_2O_3$ was used as a carrier, Pt was used as a dispersed phase, and a loading capacity was 3%. A reaction temperature was 360° C., an operating pressure was 3 MPa, a liquid hourly space velocity was 2 $h^{-1}$, and a hydrogen-oil ratio was 1000.

The isomerized biodiesel was qualitatively and quantitatively analyzed using a gas chromatography-mass spectrometer and a gas chromatography-hydrogen flame ion detector. A yield of the obtained alkanes was 90.4%, and a proportion of isoparaffins was 40.6%.

The coupling process for producing biodiesel from a waste FOG provided by the present invention has a stable and reliable process flow and strong adaptability to raw materials. The added pre-esterification process can effectively reduce contents of a fatty acid and a metal in the waste FOG and solve the problem of powdering and inactivation of a catalyst due to a too-high acid value and metal deposition. At the same time, a suspended bed pre-hydrogenation reactor is disposed in front of the fixed-bed reactor to remove impurities such as residual metals, phospholipids, and unsaponifiable matters in the waste FOG so that the fixed-bed deep deoxidation reactor is further effectively protected and a long-term stable operation of the overall system is implemented. In the present invention, a good catalytic conversion efficiency for FOG is obtained, and an alkane yield can reach more than 90%, particularly an isoparaffin yield reaches 40% or more.

The parts not mentioned in the present invention are applicable to the related art.

Obviously, the above embodiments are only examples for clear illustration and are not intended to limit the implementation. For those having ordinary skills in the art, other different forms of changes or modifications can be made based on the above description. An exhaustive list of all implementations is neither necessary nor possible. The obvious changes or modifications derived therefrom are still within the protection scope of the present invention.

The invention claimed is:

1. A coupling process for producing biodiesel from a waste FOG comprising:

a step S1 of preheating and dissolving a waste FOG charging the dissolved waste FOG into a filter (1) to remove solid impurities, and charging the filtrate and a certain amount of a short-chain alcohol and a liquid acid catalyst into a pre-esterification reactor (2) for a pre-esterification reaction to generate a pre-esterified mixture;

a step S2 of charging the pre-esterified mixture into a liquid-liquid separator (3) for liquid-liquid separation to separate out an aqueous phase and an organic phase, separating the organic phase using a second flash separator (5) to obtain a pre-esterification product I and an alcohol solvent, and charging the pre-esterification product I into a water scrubber (6) to remove metal ions to obtain an esterification product II;

a step S3 of pre-hydrogenating the esterification product II, an oil-soluble hydrogenation catalyst, a vulcanizator, and hydrogen gas in a suspended-bed reactor (7) to generate a product I;

a step S4 of charging the product I into a gas-liquid-solid separator (8), and passing the separated components through a desulfurization adsorption tower (9) and a first pressure swing adsorption tower (10) for recycling and collection of the hydrogen gas and the hydrogenation catalyst, to obtain an oil phase product I;

a step S5 of mixing the oil phase product I and hydrogen gas, charging the mixture into a fixed-bed reactor (20) for a deep deoxygenation reaction to obtain a mixed product I, and separating the mixed product I using a first gas-liquid separator (30) to obtain an oil phase product II;

a step S6 of mixing the oil phase product II and hydrogen gas, and charging the mixture into a hydroisomerization reactor (50) for an isomerization reaction under an action of a catalyst, to generate a product II; and a step S7 of charging the product II into a second gas-liquid separator (60) to separate out a gas phase and a liquid phase, and charging the liquid phase product into a fractionation tower (80) to separate out isomerized biodiesel and an aviation fuel product.

2. The coupling process for producing biodiesel from a waste FOG according to claim 1, wherein the aqueous phase separated out in the step S2 is charged into a first flash separator (4) to separate out a liquid acid catalyst and water, and the liquid acid catalyst is collected and returned to the pre-esterification reactor (2), the alcohol solvent separated out by the second flash separator (5) in the step S2 is collected and returned to the pre-esterification reactor (2), a gas phase product separated out in the step S5 is charged into a second pressure swing adsorption tower (40) to separate out CO, $CO_2$, hydrogen gas, and light hydrocarbons, and the hydrogen gas is recycled back to the fixed-bed reactor (20), and the gas phase product separated out in the step S7 is charged into a third pressure swing adsorption tower (70) to separate out hydrogen gas and light hydrocarbons, and the hydrogen gas is recycled back to the hydroisomerization reactor (50).

3. The coupling process for producing biodiesel from a waste FOG according to claim 1, wherein in the step S1, the added waste FOG is one or more of an acidified oil, a hogwash oil, and an illegally recycled waste cooking oil, the added short-chain alcohol is one of methanol, ethanol, propanol, and butanol, and the added liquid acid catalyst is one or more of sulfuric acid, hydrochloric acid, and an acidic ionic liquid.

4. The coupling process for producing biodiesel from a waste FOG according to claim 1, wherein in the step S1, a pre-esterification temperature is 50° C. to 85° C., and a mass ratio of the added waste FOG to the liquid acid catalyst to the short-chain alcohol is 1:(0.05 to 0.25):(0.80 to 1.50).

5. The coupling process for producing biodiesel from a waste FOG according to claim 1, wherein in the step S3, the added vulcanizator is one of sulfur powder, carbon disulfide, dimethyl disulfide, and $H_2S$, and the added oil-soluble hydrogenation catalyst is one or more of a molybdate imidazole ionic liquid, a molybdate pyridine ionic liquid, a molybdate quaternary ammonium ionic liquid, and a transition metal chloride ionic liquid, in which the transition metal chloride is one or more of $NiCl_2$, $CoCl_2$, $CuCl_2$, and $FeCl_3$.

6. The coupling process for producing biodiesel from a waste FOG according to claim 1, wherein in the step S3, a molar ratio of the esterification product II to the oil-soluble hydrogenation catalyst added is (1000 to 5000):1, and a molar ratio of the esterification product II to the vulcanizator added is (300 to 1000):1.

7. The coupling process for producing biodiesel from a waste FOG according to claim 1, wherein in the step S4, the product I passes through the gas-liquid-solid separator (8), and a gas phase product is charged into the desulfurization absorption tower (9) to remove residual $H_2S$ gas, followed by charging into the pressure swing adsorption tower (10) to separate out CO, $CO_2$, and light hydrocarbons and collect $H_2$, and in the step S4, the hydrogenation catalyst separated out by the gas-liquid-solid separator (8) is filtered and charged into the suspended-bed reactor (7) for recycling, and the oil phase product I is charged into the fixed-bed reactor (20) for the deep deoxygenation reaction.

8. The coupling process for producing biodiesel from a waste FOG according to claim 1, wherein the hydrogenation catalyst added in the step S3 is one of NiMoS and CoMoS supported on graphitized mesoporous carbon, and regarding the prehydrogenation reaction, an operating pressure is 2 MPa to 10 MPa, a reaction temperature is 280° C. to 400° C., a liquid hourly space velocity is 0.2 $h^{-1}$ to 8 $h^{-1}$, and a hydrogen-oil ratio is 500 to 1500.

9. The coupling process for producing biodiesel from a waste FOG according to claim 1, wherein in the step S6, the catalyst used in the hydroisomerization reactor (50) is one of $Pt/ZrO_2$, $Pt/Al_2O_3$, and $Pt/ZrPO_x$.

10. The coupling process for producing biodiesel from a waste FOG according to claim 1, wherein in the step S6, regarding the hydroisomerization reaction, an operating pressure is 2 MPa to 10 MPa, a reaction temperature is 280° C. to 400° C., a liquid hourly space velocity is 0.2 $h^{-1}$ to 8 $h^{-1}$, and a hydrogen-oil ratio is 500 to 1500.

11. The coupling process for producing biodiesel from a waste FOG according to claim 1, wherein in the step S7, an operating temperature in the second gas-liquid separator (60) is 25° C. to 45° C., the fractionation tower (80) is of a sieve plate type or a packed type, a temperature at a bottom of the tower is 200° C. to 360° C., and an operating pressure is 0.1 MPa to 0.4 MPa.

* * * * *